US007654943B2

(12) United States Patent
Sapia

(10) Patent No.: US 7,654,943 B2
(45) Date of Patent: Feb. 2, 2010

(54) COLLAPSIBLE HOOP

(75) Inventor: Thomas L. Sapia, Ojai, CA (US)

(73) Assignee: Bodyhoops, LLC, Ojai, CA (US)

( * ) Notice: Subject to any disclaimer, the term of this patent is extended or adjusted under 35 U.S.C. 154(b) by 0 days.

(21) Appl. No.: 12/076,208

(22) Filed: Mar. 14, 2008

(65) Prior Publication Data

US 2008/0227608 A1 Sep. 18, 2008

Related U.S. Application Data

(60) Provisional application No. 60/895,030, filed on Mar. 15, 2007.

(51) Int. Cl.
*A63B 21/22* (2006.01)

(52) U.S. Cl. ..... 482/110; 482/139; 482/148

(58) Field of Classification Search ..... 482/110, 482/23, 24, 139, 148; 446/236, 48, 237; 135/132, 88.06, 135, 117.96; 473/478, 473, 473/459, 470; 296/136.13; 206/335; 63/15, 63/15.2; 119/496

See application file for complete search history.

(56) References Cited

U.S. PATENT DOCUMENTS

| | | | | |
|---|---|---|---|---|
| 6,939,270 | B2 * | 9/2005 | Wang et al. | 482/27 |
| 7,467,868 | B2 * | 12/2008 | Beate et al. | 351/158 |
| 2003/0148702 | A1 * | 8/2003 | Campbell | 446/236 |
| 2008/0113582 | A1 * | 5/2008 | Campbell | 446/236 |

OTHER PUBLICATIONS

Brochure, Bodyhoops, Inc., Ojai, California, Jan. 2007.

* cited by examiner

*Primary Examiner*—Lori Baker
(74) *Attorney, Agent, or Firm*—Davidson Berquist Jackson & Gowdey, LLP; Brian Siritzky

(57) ABSTRACT

A foldable hoop has an outer tube; and one or more swivel mechanisms connecting ends of the outer tube to form the hoop. The swivel mechanism is formed from two pieces of tubing held together at ends thereof, said two pieces of tubing being rotatable with respect to each other. The tubes forming the swivel mechanism may be solid plastic or hollow tubing, and they are connected to the outer tube using, e.g., rivets, screws, staples.

16 Claims, 8 Drawing Sheets

COLLAPSIBLE HOOP

RELATED APPLICATIONS

This application is related to and claims priority from U.S. Provisional Patent Application No. 60/895,030, titled "Collapsible Hoop", filed Mar. 15, 2007, the entire contents of which are incorporated herein for all purposes.

COPYRIGHT NOTICE

A portion of the disclosure of this patent document contains material which is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

FIELD OF THE DISCLOSURE

This invention relates to exercise hoops, and, more particularly to collapsible hoops.

BRIEF DESCRIPTION OF THE DRAWINGS

The following description, given with respect to the attached drawings, may be better understood with reference to the non-limiting examples of the drawings, wherein.

THE PRESENTLY PREFERRED EXEMPLARY EMBODIMENTS

Introduction & Background

Adult or exercise hoops are becoming popular for fitness, relaxation, dance, performance, and fun. While similar to a so-called "hula hoop"—the plastic kind children use—an exercise hoop is generally much bigger and much heavier. As used herein the term "hoop" will refer to an exercise hoop.

A typical hoop is made by taking piping/tubing of appropriate length, wrapping it tightly in spirals with several kinds tape for color and texture, and joining it to form a large loop. Typically the piping is PET (poly ethylene terephthalate) tubing and is about one inch in diameter, though other diameters may be used. Those skilled in the art will realize and understand, upon reading this description, that the length of the piping must be sufficient to form a hoop of appropriate diameter. For example, the hoops produced by BodyHoops, LLC of Ojai, Calif., the assignee of the present application, are available in three diameter sizes: small 38-39"—for youth or adults who are under 5'4"; medium 41-42" for average height; and large 44-45" for taller or larger bodies. Those skilled in the art will realize and understand, upon reading this description, that different diameter hoops can be made. Typical hoops produced by BodyHoops weight about 2 pounds.

Adult hoops are large and difficult to transport. This makes them relatively expensive to ship, problematic to sell (much floor space is needed for display and for storage of inventory), and hard to transport to events (it is awkward to carry them with in a car or bicycle or on an airplane).

One prior approach to this problem is to use a hoop that can be disassembled into smaller pieces. But the mechanisms for holding the pieces together are relatively expensive, heavy, and awkward.

The inventor realized that if a hoop could be folded, it would be possible to make two loops out of the hoop.

Description

Figure 1A:
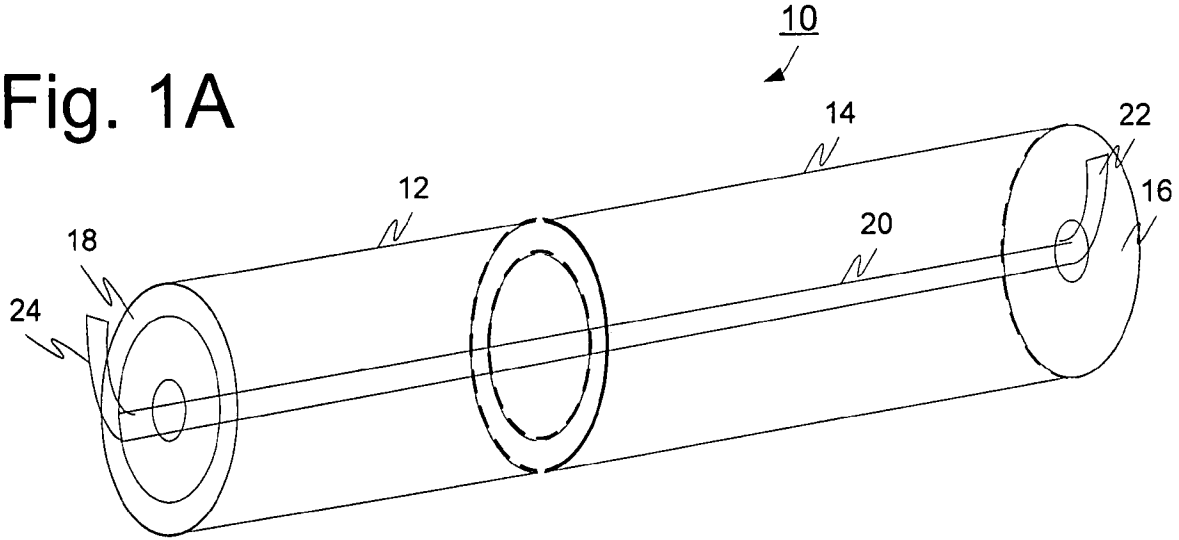
FIG. 1A shows a swivel mechanism used to connect two ends of a tube to form a foldable hoop.
Figure 1C:
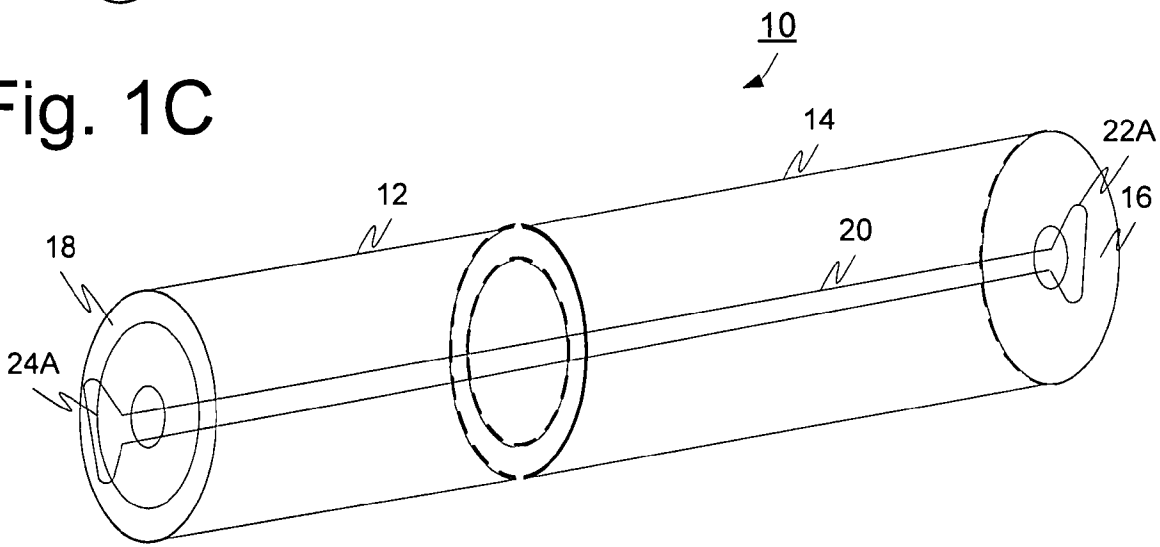
FIG. 1C shows another swivel mechanism used to connect two ends of a tube to form a foldable hoop.
Figure 1B:
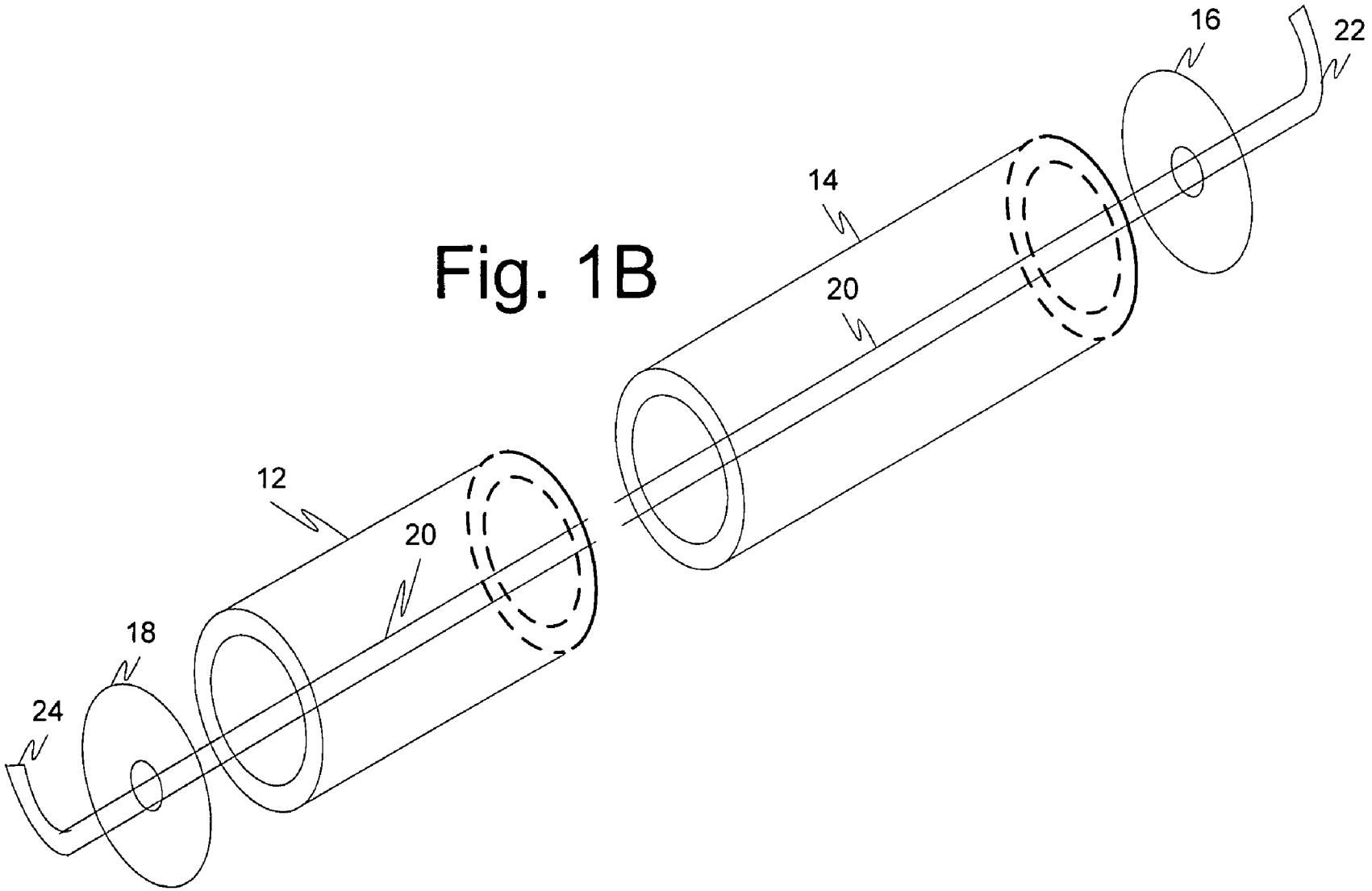
FIG. 1B shows an exploded view of the swivel mechanism of FIG. 1A.
Figure 1D:
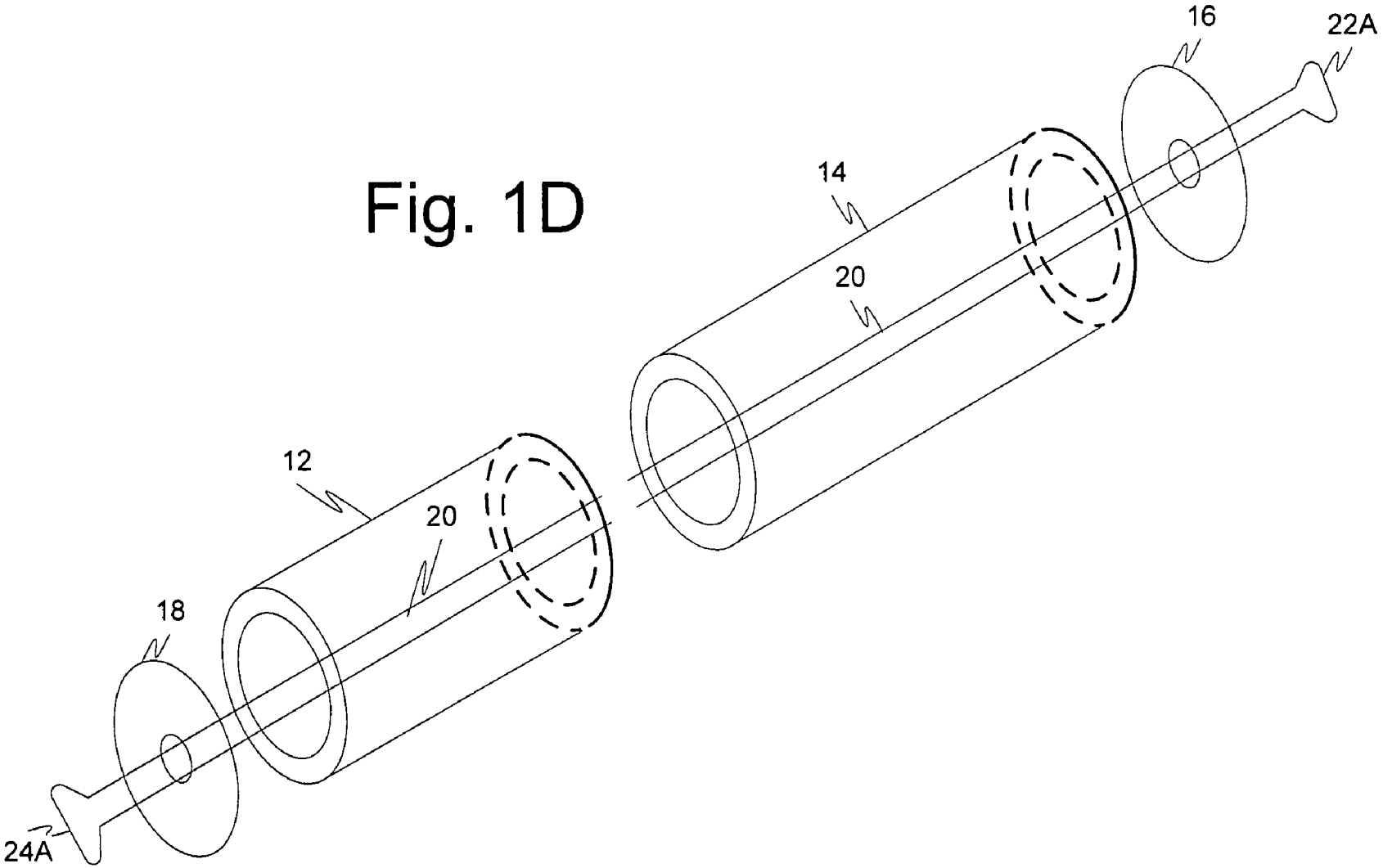
FIG. 1D shows an exploded view of the swivel mechanism of FIG. 1C.

FIG. 1A shows a swivel mechanism 10 used to connect two ends of a tube to form a foldable hoop, and FIG. 1B shows an exploded view of the swivel mechanism of FIG. 1A. As shown in the drawings, the swivel mechanism 10 is formed of two pieces of tubing 12, 14 (preferably PVC—Poly Vinyl Chloride, schedule 80). The two pieces of tubing 12, 14 are preferably of different lengths (e.g., 2.75 inches and 1.25 inches). Two washers 16 and 18 are provided, and a center rod 20, preferably steel, has bends on each end 22, 24 to hold the two tubes 12, 14 together. The bends are preferably at ninety degrees to the rod and must be long enough to hold the tubes together while not extending beyond their diameters. In one presently preferred embodiment, the diameter of the tubes 22, 24 is 0.75 inches, and each bend is about a quarter of an inch. The center rod may be crimped at its ends (instead of being bent), as shown in FIGS. 1C-1D (ends 22A, 24A). Crimping the rod ends is currently considered preferable to bending them, since it is generally an easier manufacturing operation and uses less material. A particular swivel mechanism may also use a combination of bending (on one end) and crimping (on the other). Those skilled in the art will realize and understand, upon reading this description, that different and/or other ways of keeping the two pieces of tubing together may be used and are contemplated herein. For example, allthread can be used instead of the bent shaft, but is more costly.

The swivel mechanism 10 may be assembled as follows: the PVC pieces 12, 14 are connected by the center rod 20 passing through two washers 16, 18, one at each end. The bent (or crimped) ends 22, 24 (or 22A, 24A, if crimped), capture the washers. The washers hold the PVC pieces rotatably in place.

Figure 2A:
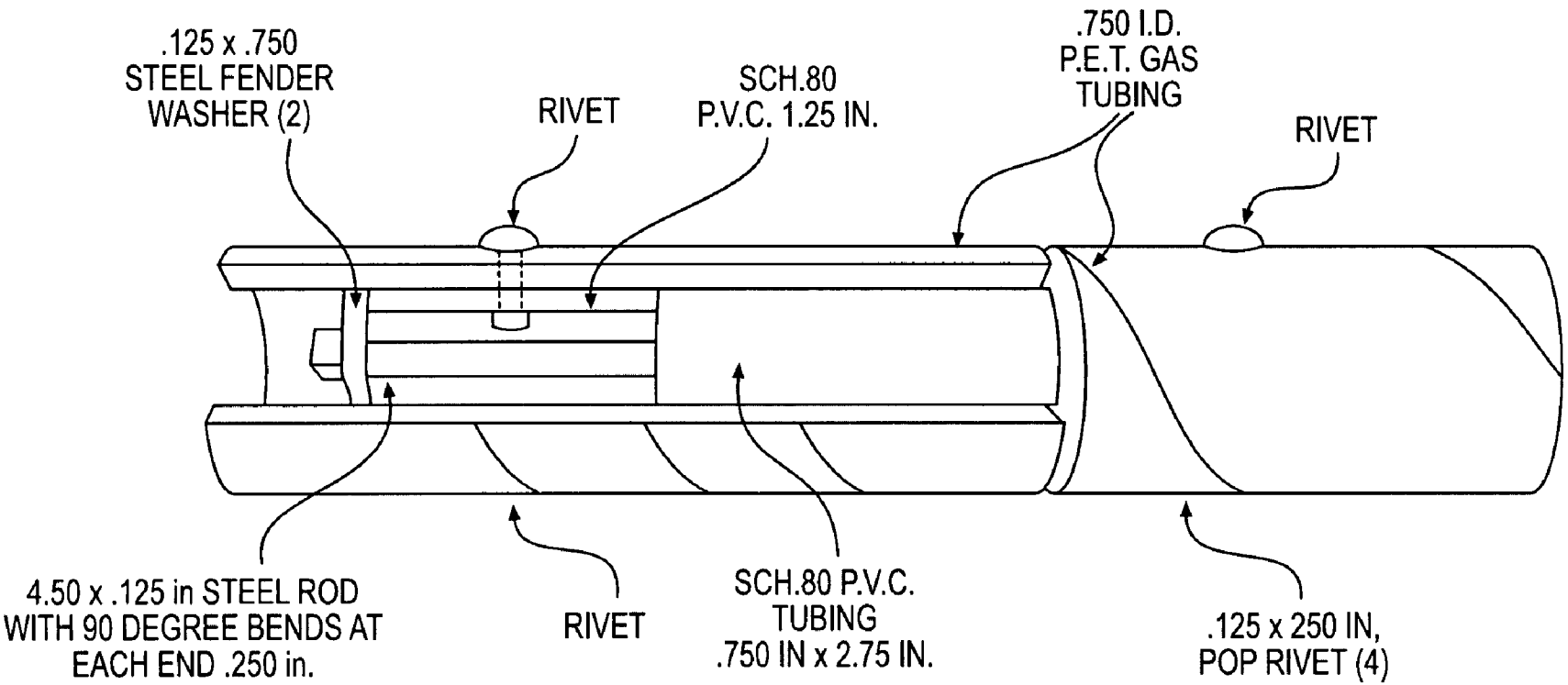
FIGS. 2A-2B depicts a cut-away view of a swivel mechanism connecting two ends of a hoop.
Figure 2B:
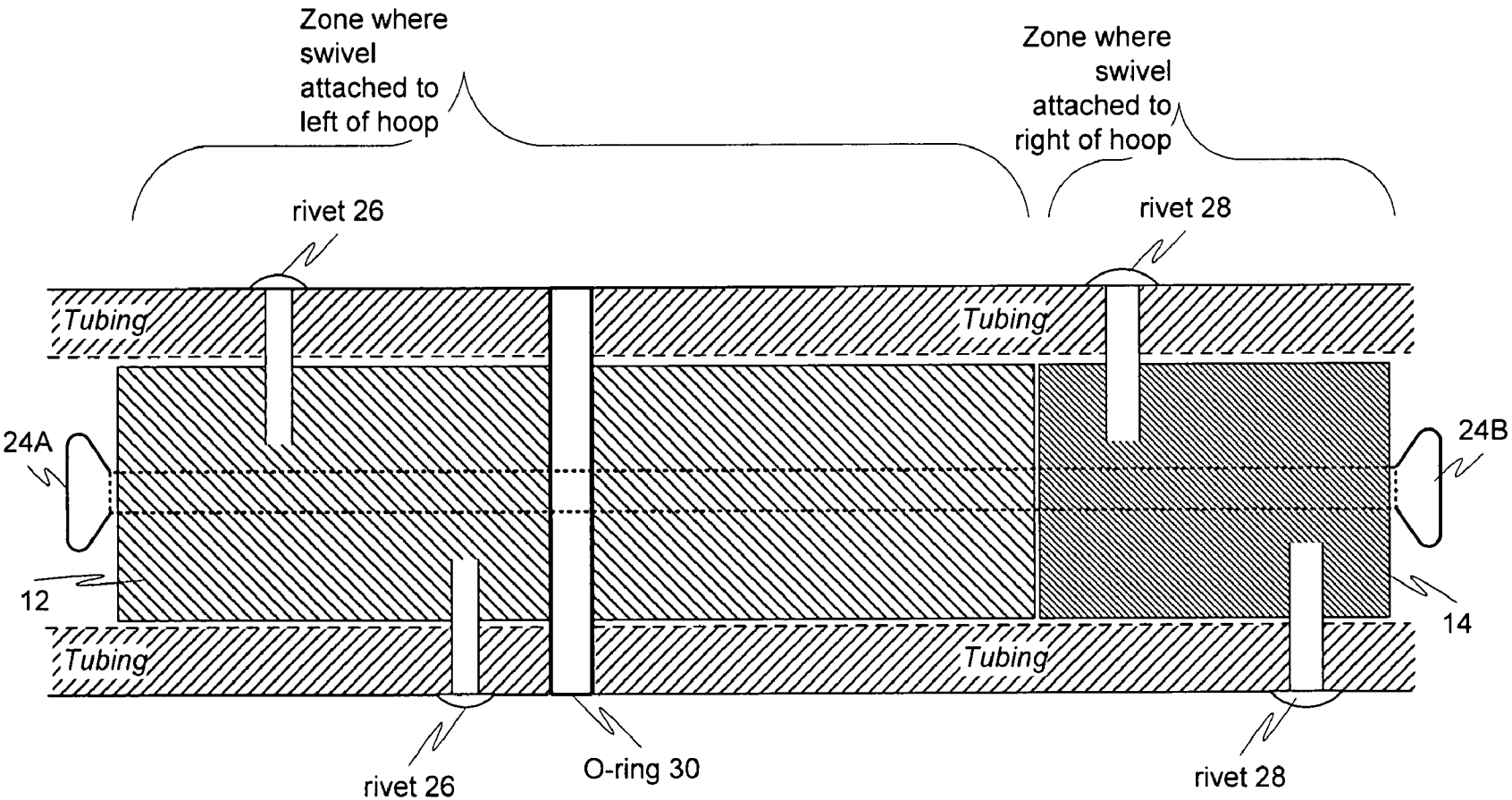

FIGS. 2A-2B depict a cut-away view of a swivel mechanism connecting two ends of a hoop. As can be seen from the drawings, the ends of the swivel assembly mechanism are inserted into the two ends of the hoop (creating a circle). The ends are drilled at appropriate distances and pop-riveted or screwed into place (e.g., with rivets 26 and 28). This process attaches the swivel mechanism to the larger hoop and causes the hoop to close.

As shown in FIG. 2A, the swivel piece on the right extends beyond the right PET end about 1.25 inches into the left PET end (the opposite side of the PET tubing). The extended PVC slides against the inner 1.5 inch surface of the PET on the left. Lubrication may be added to help slippage.

These dimensions give the finally assembly the appropriate trade-off between strength of the bearing surface and deformation of the entire circle of the hoop. Some friction in the slippage is desirable to prevent the energy of the coiled hoop from springing apart too quickly.

As an alternate to the two hollow PVC pieces described above, the swivel mechanism may also be formed using two pieces of solid plastic. That is, use a solid plastic core instead of a hollow tube for each side of the swivel connector. In the case of a solid plastic core, it is necessary to form a hole (e.g., by drilling) through the core for the swivel connector which can be formed e.g., using heavy wire or a screw. The solid core can be stapled into the hoop itself, rather than set with screws or rivets, making the mechanism easier and cheaper to assemble.

As shown in FIG. 2B, an O-ring 30, preferably rubber, may used between the PET joint around the swivel in order to provide a cleaner joint and to eliminate potential pinching.

Those skilled in the art will realize and understand, upon reading this description, that the PVC may be connected to the outer PET tube in different ways. For example, instead of (or in combination with) rivets, screws or pneumatic nails or staples could be used.

Those skilled in the art will realize and understand, upon reading this description, that PVC is used because it is commonly available in the appropriate dimensions and is quite strong. Other materials may be used for the swivel mechanism.

Thus is described a small part that connects the two ends of the hoop during manufacture, and which includes a swivel device. The swivel device makes it possible, by twisting the PVC, to make two loops out of one. The two loop "folded" hoop can easily be packed in a bag, e.g. a decorative fabric carrying case, for transportation and storage.

Figures 3A, 3B:
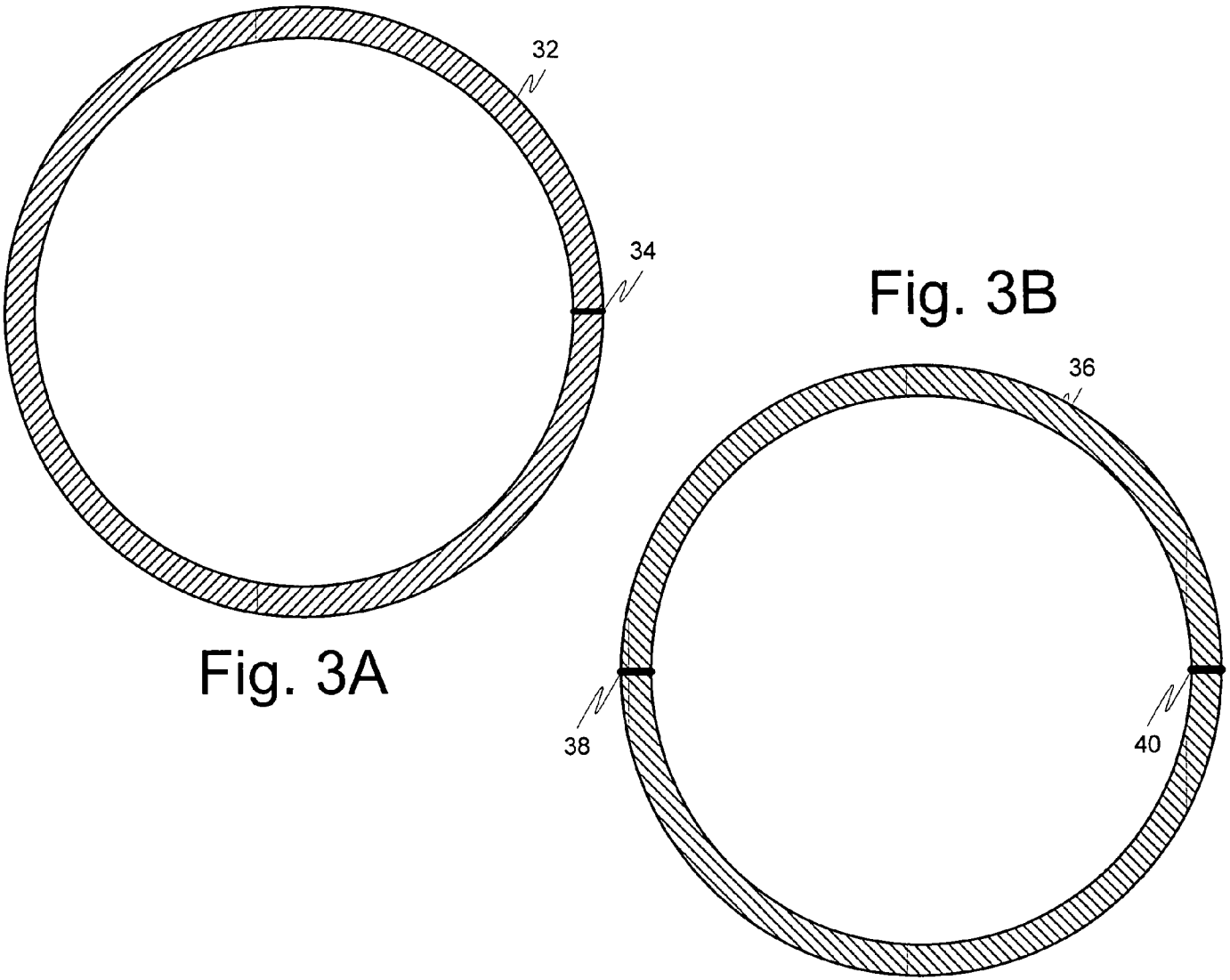
FIG. 3A shows a foldable/collapsible hoops using one swivel mechanism.
FIG. 3B shows a foldable/collapsible hoops using two swivel mechanisms located opposite each other.

FIG. 3A shows a foldable/collapsible hoop 32 with a swivel mechanism (at join location 34) as described above, and FIGS. 4A-4E show the foldable/collapsible hoop of FIG. 3A being folded.

Figure 4B:
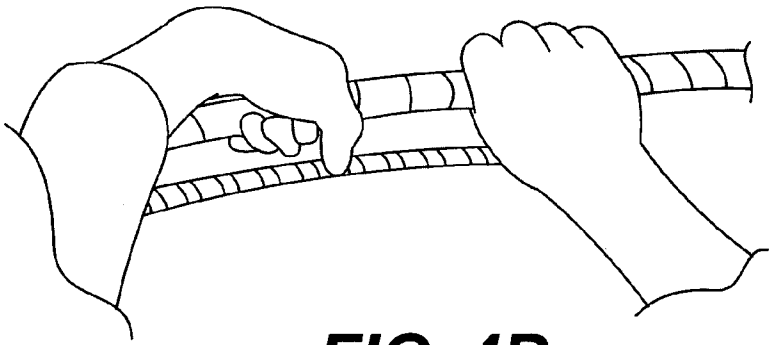
FIGS. 4A-4E show a foldable/collapsible hoop being folded.
Figure 4C:
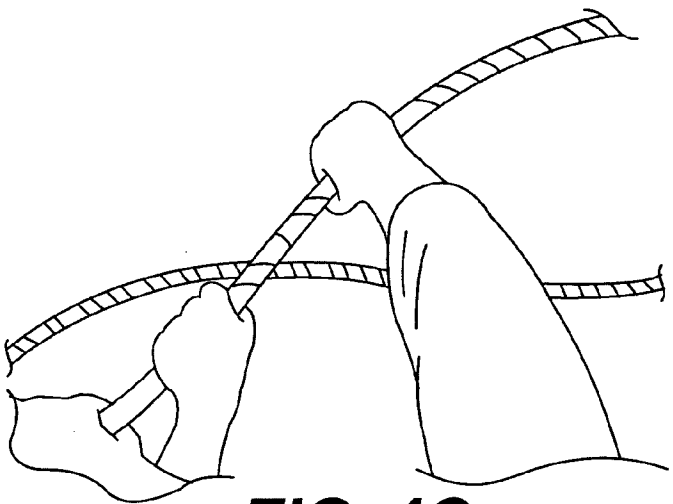
Figure 4A:
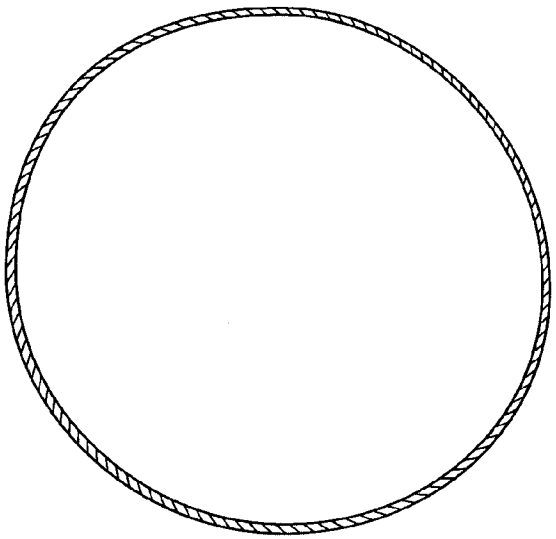
Figure 4E:
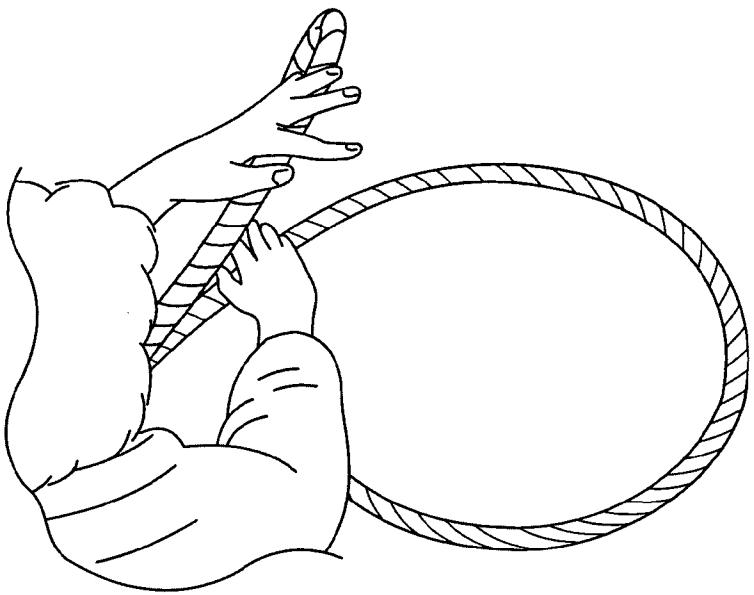
Figure 4D:
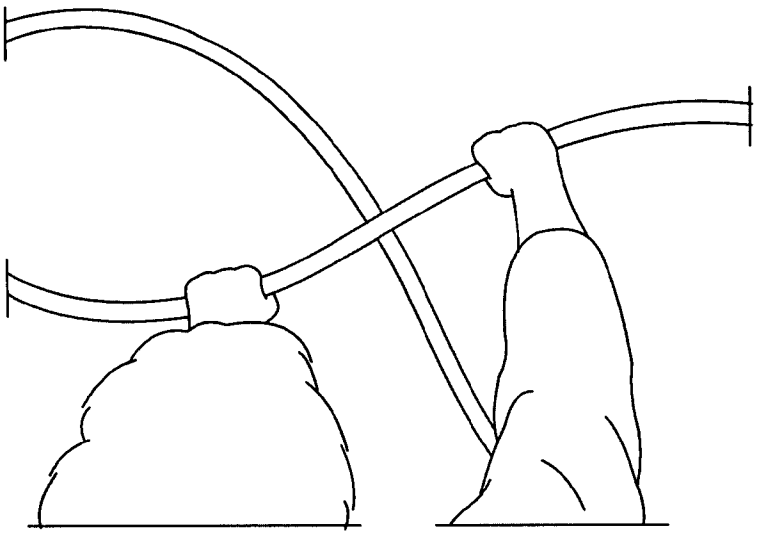

The hoop 32 in FIG. 3A has a single swivel mechanism located at the join 34. Those skilled in the art will realize and understand, upon reading this description, that a hoop may be formed with more than one swivel mechanism. For example, the hoop 36 shown in FIG. 3B has two swivel mechanisms, one located at the join 38 and the other located opposite it at the join 40. If a hoop has two swivel mechanisms (as shown in FIG. 4B), these are preferably located 180 degrees apart (i.e., on opposite sides of the hoop). Using two swivels provides certain benefits and advantages. It makes it easier to fold and unfold hoops; a hoop can fold and unfold in either direction. Users of these hoops will realize that having two swivel mechanisms also makes it easier to incorporate folding and unfolding movements in an actual hooping session. Additionally, having two swivel mechanisms causes less wear and tear on the polyethylene tubing and on the tape wrapping the tubing. Those of ordinary skill in the art will understand, upon reading this description, that if two swivel mechanisms are used, then the hoop will need to be formed from two equal-sized hoop portions, each one forming half of the final hoop.

While certain configurations of structures have been illustrated for the purposes of presenting the basic structures of the present invention, one of ordinary skill in the art will appreciate that other variations are possible which would still fall within the scope of the appended claims. While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A foldable hoop comprising:

an outer tube; and a swivel mechanism connecting the ends of the outer tube to form the hoop, whereby the swivel mechanism permits the ends of the outer tube to rotate relative to each other along a longitudinal axis of the outer tube, and wherein the swivel mechanism comprises: two tubes rotatably connected to each other and rotatable about longitudinal axes thereof, said two tubes being distinct from said outer tube.

2. The hoop of claim 1 wherein the swivel mechanism comprises:

two pieces of tubing held together at ends thereof, said two pieces of tubing being rotatable with respect to each other about longitudinal axes thereof.

3. The hoop of claim 1 wherein the outer tube is about one inch in diameter.

4. The hoop of claim 1 wherein the outer tube is formed of PET (poly ethylene terephthalate) tubing.

5. The hoop of claim 1 wherein the swivel mechanism is connected to the outer tube with rivets or screws.

6. The hoop of claim 1 wherein the two tubes that comprise the swivel mechanism comprise:

PVC (Poly Vinyl Chloride) tubing.

7. The hoop of claim 6 wherein the PVC tubing is schedule 80.

8. The hoop of claim 1 wherein the two tubes that comprise the swivel mechanism are of different lengths.

9. A foldable hoop comprising:

an outer tube; and a swivel mechanism connecting the ends of the outer tube to form the hoop, whereby the swivel mechanism permits the ends of the outer tube to rotate relative to each other, wherein the swivel mechanism comprises:

two pieces of tubing held together at ends thereof, said two pieces of tubing being rotatable with respect to each other, and wherein the swivel mechanism further comprises:

a rod that passes between the two tubes; and two washers, wherein the ends of the rod bent or crimped to prevent the two tubes from moving apart.

10. The hoop of claim 1 further comprising an O-ring positioned between the two ends of the outer tube.

11. The hoop of claim 1 wherein the two tubes that comprise the swivel mechanism are both hollow.

12. The hoop of claim 1 wherein the two tubes that comprise the swivel mechanism are both solid plastic.

13. A foldable hoop comprising:

at least one outer tube portion; and at least one swivel mechanism connecting ends of the said at least one outer tube portion to form the hoop, whereby each swivel mechanism permits the ends of the outer tube connected thereto to rotate relative to each other, and wherein the swivel mechanism comprises two tubes rotatably connected to each other along a longitudinal axes thereof, said two tubes being distinct from said at least one outer tube portion.

14. A foldable hoop comprising:

at least one outer tube portion; and at least one swivel mechanism connecting ends of the said at least one outer tube portion to form the hoop, whereby each swivel mechanism permits the ends of the outer tube connected thereto to rotate relative to each other along a longitudinal axis thereof, and wherein at least one swivel mechanism comprises two tubes rotatably connected to each other, and a rod that passes between the two tubes, wherein the ends of the rod are formed to prevent the two tubes from moving apart.

15. The foldable hoop of claim 1 wherein one of said two tubes that comprise the swivel mechanism is fixedly connected to a first end of the outer tube, and wherein another of said two tubes that comprise the swivel mechanism is fixedly connected to a second end of the outer tube.

16. The foldable hoop of claim 15 wherein the one of the two tubes that comprise the swivel mechanism is fixedly connected to the first end of the outer tube using one or more of: a staple, a screw, and a rivet.

* * * * *